US005907912A

United States Patent [19]

Alaimo

[11] Patent Number: 5,907,912

[45] Date of Patent: Jun. 1, 1999

[54] TANDEM CLOSURE SYSTEM FOR SHOES

[75] Inventor: Gregory A. Alaimo, Mayfield Village, Ohio

[73] Assignee: Acor Orthopaedic, Inc., Cleveland, Ohio

[21] Appl. No.: 08/929,241

[22] Filed: Sep. 10, 1997

[51] Int. Cl.[6] ..... A43C 11/00

[52] U.S. Cl. ..... 36/50.1

[58] Field of Search ..... 36/50.1, 54

[56] References Cited

U.S. PATENT DOCUMENTS

| | | |
|---|---|---|
| 4,081,916 | 4/1978 | Salisbury . |
| 4,414,761 | 11/1983 | Mahood . |
| 4,628,622 | 12/1986 | McBarron . |
| 5,353,483 | 10/1994 | Louviere . |
| 5,357,691 | 10/1994 | Hyde et al. . |
| 5,469,640 | 11/1995 | Nichols . |

*Primary Examiner*—Ted Kavanaugh

*Attorney, Agent, or Firm*—Fay, Sharpe, Beall, Fagan, Minnich & McKee

[57] ABSTRACT

A shoe closure system is capable of operating in two modes. One is a conventional mode wherein the closure is secured in a conventional manner using a threaded and tied lacing member. The other is a quick-fastening mode where the closure may be secured using a hook-and-loop fastener and wherein the shoe may be opened without unlacing the lace member from the lace bars. A removable lace bar is provided with eyelets and a hook-and-loop fastener such that it may be releasably secured in overlying fashion to one of the other lace bars. In the first closure mode, the removable lace bar and one of the conventional lace bars function as a single lace bar with the other conventional lace bar. In the quick-fastening closure mode, the lacing member is laced only through the removable lace bar and one of the conventional lace bars such that the removable lace bar may be selectively fastened to the other conventional lace bar.

11 Claims, 2 Drawing Sheets

FIG. 1
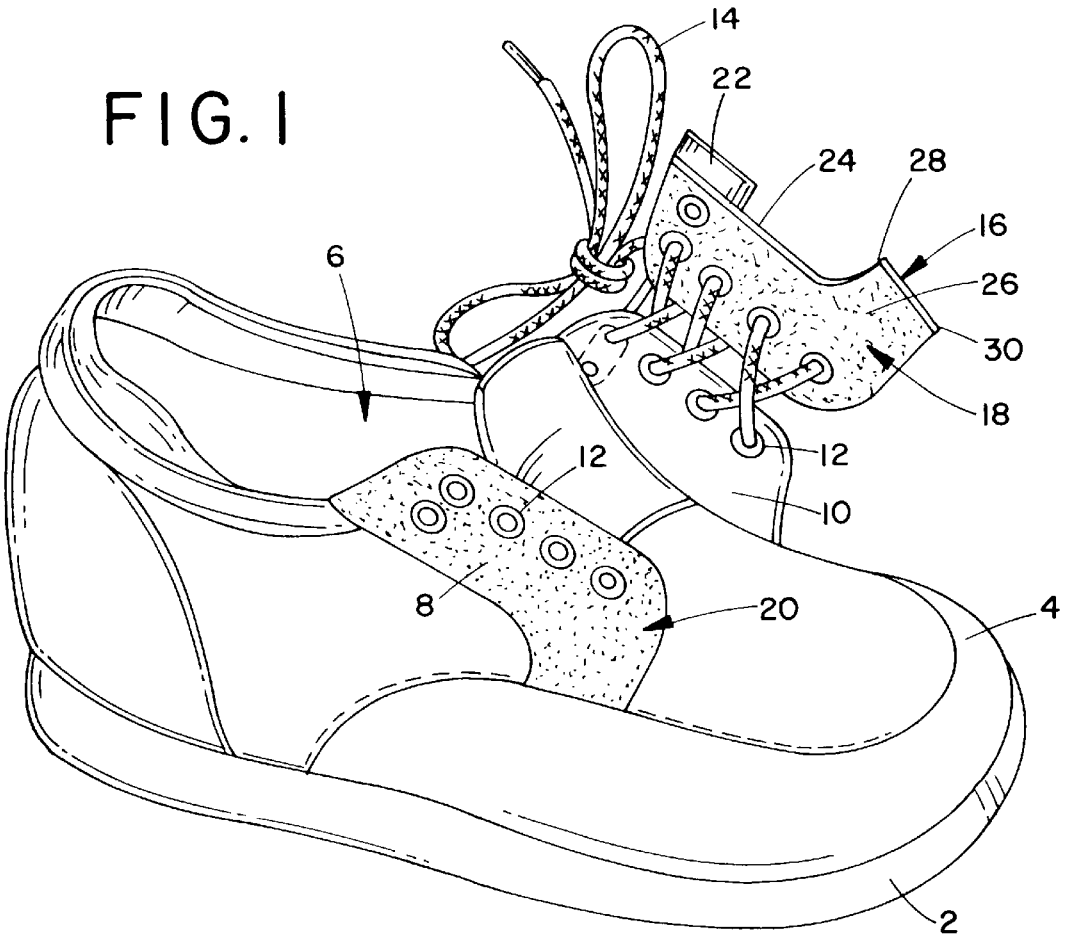
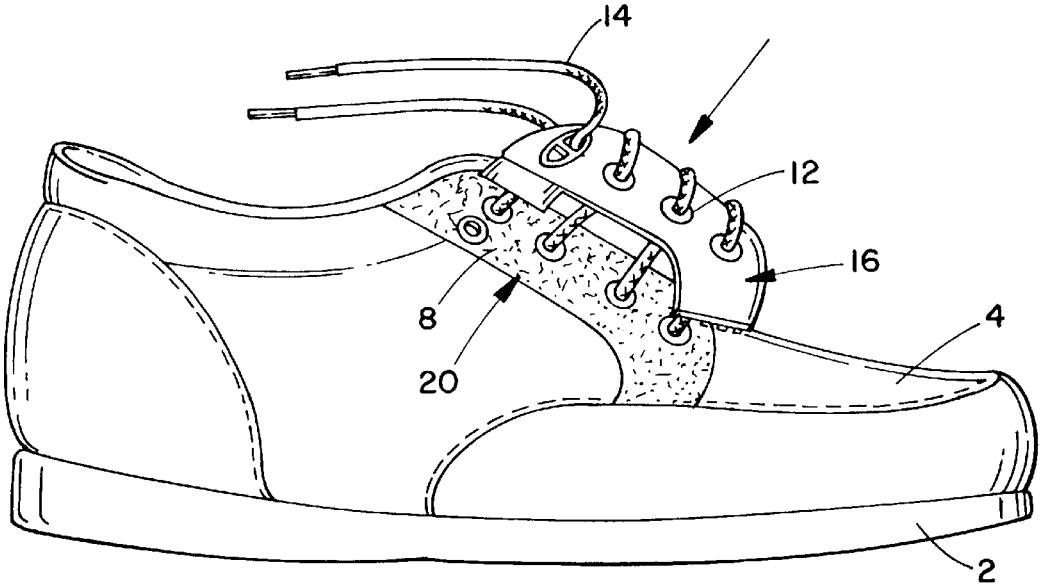
FIG. 3

FIG. 2
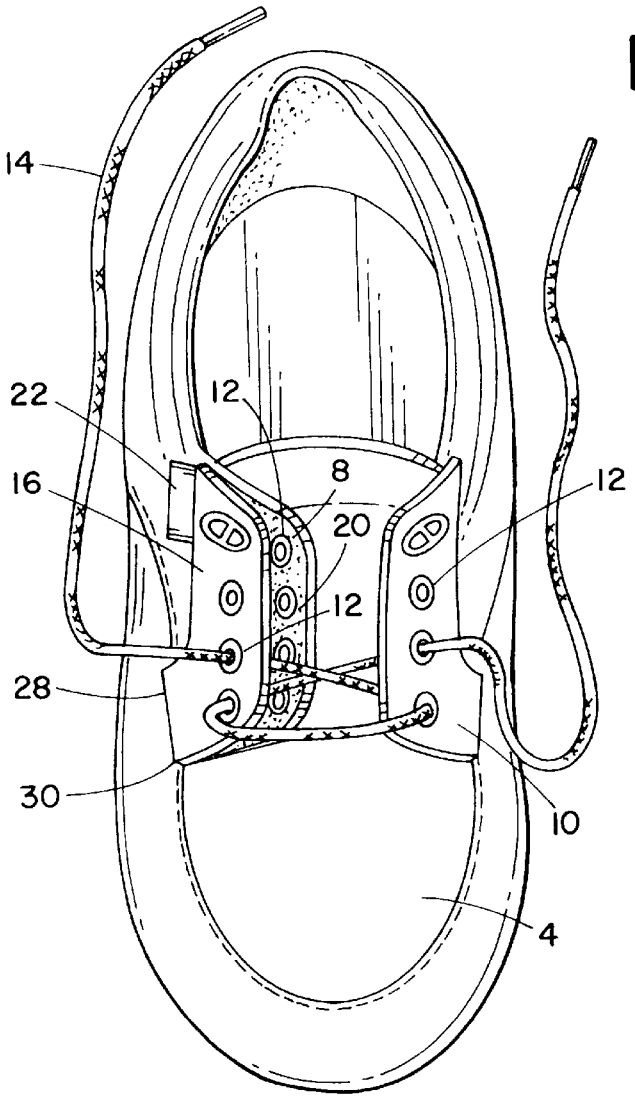
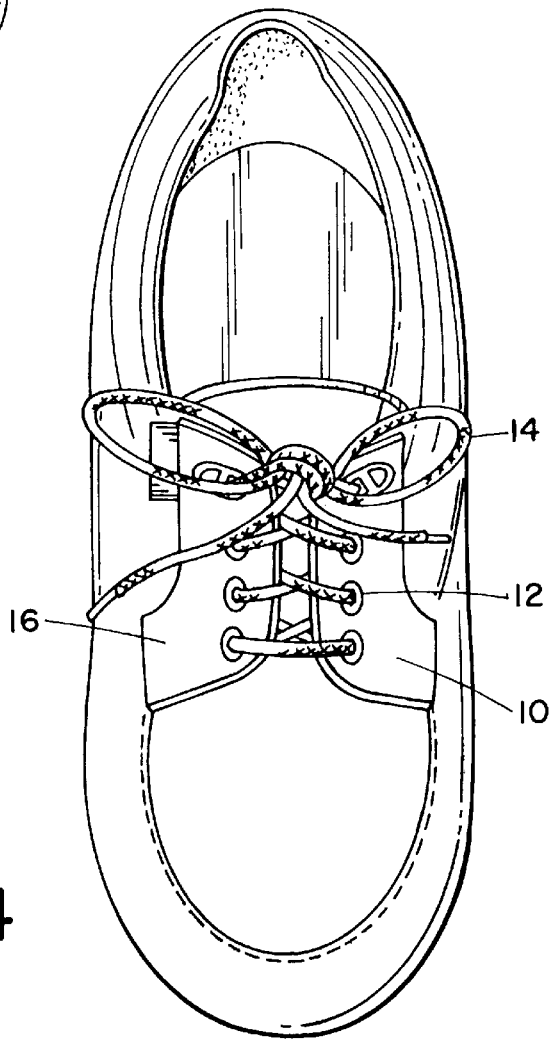
FIG. 4

TANDEM CLOSURE SYSTEM FOR SHOES

BACKGROUND OF THE INVENTION

This invention pertains generally to the art of footwear articles. Specifically, the invention pertains to closure arrangements for footwear articles.

The invention is particularly applicable to footwear articles, especially shoes that may be put on and removed by persons having limited dexterity. The invention will be described with particular reference to that environment. It will be appreciated, however, that the invention has broader application and may be advantageously employed to any closure system, for example a closure for clothing articles, that incorporates a lacing member to draw together opposed lace bars.

Numerous efforts to improve conventional closure systems, especially on footwear articles, have been proposed in the past. Many recent efforts have involved the use of hook-and-loop fasteners such as VELCRO in conjunction with pre-existing structure on a footwear article.

For example, Mahood, in U.S. Pat. No. 4,414,761, describes an adjustable closure especially applicable to athletic shoes with a large instep. Mahood's shoe closure incorporates a conventional lace bar on the medial (inner) side of the shoe and a removable lace bar on the lateral (outer) side of the shoe. The removable lace bar is secured to the shoe upper by VELCRO. When the removable lace bar is fastened in place to the lateral side of the shoe upper, it may be laced and tied to the medial lace bar in a conventional manner. Once laced and tied, the closure may be opened and closed by releasing or attaching the VELCRO lace bar.

Another hook-and-loop fastening structure is described in U.S. Pat. No. 4,081,916 to Salisbury. That patent describes a quick-release lace tightening arrangement for footwear articles that incorporates VELCRO patch secured to the lace ends. Salisbury is concerned with providing for quick re-tightening of the shoe closure. The length of the lace member of Salisbury is adjusted by a clamp that is hidden from view when the patch is secured to its counterpart patch. Adjustment of Salisbury's closure is by way of the adjustment of a clamp that secures the lacing member ends.

While VELCRO type fasteners such as those of Mahood and Salisbury may render closure fastening and unfastening easier and quicker, these hook-and-loop fasteners may tend to loosen during shoe use and may not provide as secure a fastening capability as conventional lacing members. The use of shoe closures that rely solely upon hook-and-loop fasteners thus represents a sacrifice of fastener ability over conventional laces to provide ease of use. Prior art closures do not combine the benefit of hook-and-loop fasteners with those of quick-fastening and more conventional modes of fastening such as laces.

It would, therefore, be desirable to provide a closure arrangement that can function both as a conventional fastening closure, wherein the lacing member is secured through lace bars, and as a quick-fastening closure, wherein the lacing member can be detached from and fastened to the lace bars quickly and easily without unlacing.

SUMMARY OF THE INVENTION

The present invention contemplates a new and improved structure that overcomes all of the aforementioned problems and others and provides a shoe closure system that is capable of fastening in two modes. One is a conventional fastening mode wherein the closure is secured in a conventional manner using a threaded and tied lacing member. The other is a quick-fastening mode where the closure may be secured using a hook-and-loop fastener and wherein the lacing member may be removed without unlacing from the lace bars. These advantages are achieved by the use of a removable lace bar that cooperates with the lace bars on the shoe upper. The removable lace bar is releasably secured in overlying fashion to one of the shoe upper lace bars. In the conventional fastening mode, the removable lace bar and one of the shoe upper lace bars function as a single lace bar with the other shoe upper lace bar. In the quick-fastening mode, the lacing member is laced only through the removable lace bar and one of the shoe upper lace bars such that the removable lace bar may be selectively fastened to the other shoe upper lace bar using the hook-and-loop fastener.

Another advantage of the present invention is the provision of a shoe closure system having an additional lace bar or flap that lines up completely along the underlying lace bar and is symmetrical with the lace bar on the opposed side of the shoe so that the additional lace bar is essentially invisible. In other words, a bystander cannot easily recognize that one side of the shoe has two overlying lace bars whereas the opposed side of the shoe only has a single lace bar.

Still another advantage of the present invention is the provision of a shoe closure system in which an overlying additional lace bar has a tab provided on it to facilitate grasping of the lace bar via the tab for removability from the underlying lace bar to which it is secured by hook-and-loop fasteners.

Yet another advantage of the present invention is the provision of a shoe closure system in which two lace bars are provided on one side of the shoe in an overlying relationship and wherein a layer of hook-and-loop material completely covers the adjoining surfaces of the two lace bars that are selectively secured together. Such a design allows for a more secure connection between the two lace bars. In this system, the hook-and-loop material also surrounds the eyelets extending through the two overlying lace bars.

Many other advantages and benefits of the invention will become apparent to those skilled in the art upon a reading and an understanding of the detailed description which follows.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof.

FIG. 1 is an isometric that depicts a footwear article incorporating a closure according to the present invention, wherein the closure is configured in a quick-fastening mode.

FIG. 2 is a top plan view of the footwear article of FIG. 1, wherein the closure is in the process of being laced in a quick-fastening mode.

FIG. 3 is a side elevational view that depicts the footwear article of FIG. 1 incorporating the closure according to the present invention, wherein the closure is configured in a conventional fastening mode.

FIG. 4 is a top plan view of the footwear article of FIG. 1 incorporating the closure according to the present invention, wherein the closure is configured in a quick-fastening mode.

DETAILED DESCRIPTION OF THE PREFERRED EMBODIMENT

Referring now to the drawings wherein the showings are for the purposes of illustrating the preferred embodiment in the invention only and not for purposes of limiting it, FIGS. 1–4 show generally a footwear article incorporating a closure system according to a preferred embodiment of the present invention. While the closure system according to the present invention is illustrated as being employed on a particular type of footwear article or shoe, it should be appreciated that the closure system could be used on a variety of different types of footwear articles, as well as other items which incorporate lace bars.

Referring to FIG. 1, there is illustrated a shoe comprising a shoe sole 2 and an upper 4 which defines a space 6 for a wearer's foot therein. Those of ordinary skill will recognize that the shoe illustrated in FIG. 1 is a right foot shoe and that the corresponding left foot shoe (not shown) will be identical with respect to the described elements, except that the medial and lateral sides will be reversed. Upper 4 is comprised of a number of panels which may be leather or fabric, including a lateral lace bar a and a medial lace bar 10. Each lace bar 8, 10 has a plurality of eyelets 12 formed therein for permitting passage of lacing member 14 therethrough. The aforementioned structure comprises the general structure of a conventional shoe.

In accordance with the present invention, there is provided a removable lace bar 16, which is shaped in like fashion to lateral lace bar 8. A lower face of removable lace bar 16 is provided with a layer of hook-type fastener material 18, such as VELCRO, on one surface. Lateral lace bar 8 is provided on its upper surface with a layer of loop-type fastener material 20. The shoe illustrated in FIG. 1 has been laced in the quick-fastening mode wherein lacing member 14 secures removable lace bar 16 to medial lace bar 10. In this mode, lacing member 14 does not extend through eyelets 12 of lateral lace bar 8. The closure may be adjusted by appropriate positioning of removable lace bar 16 on lateral lace bar 8 using the hook-type fasteners 18 and cooperating loop-type fasteners 20.

There is a tab 22 provided on an outboard side of the removable lace bar 16. As is evident from FIG. 1, the tab does not have a layer of hook-and-loop material disposed on it. Rather, the purpose of the tab is to enable the person with limited physical dexterity to grasp the tab and by so doing enable that person to detach the removable lace bar 16 from the lateral lace bar 8. It is also evident from FIG. 1 that the removable lace bar 16 as well as the underlying lace bar 8, includes an elongated section 24 as well as a protrusion 26 extending therefrom. The protrusion includes a pair of corners 28 and 30 at which the removable lace bar 16 can be grasped by detaching that corner from the underlying lateral lace bar 8. These corners 28 and 30 provide the wearer of the shoe with two additional points at which the removal of the removable lace bar 16 from the underlying lateral lace bar 8 can be initiated.

While the invention is described herein with particular application to footwear to be worn by persons with limited dexterity, it will be appreciated that the benefits of the invention may also be enjoyed by those without physical challenges. For example, while tab 22 is described as being beneficial to those with limited dexterity, it will also improve the grip of those whose dexterity is not so limited.

FIG. 2 illustrates the lacing configuration of the shoe of FIG. 1 in the quick-fastening mode. More specifically, it can be seen that the lacing member 14 extends only through the eyelets 12 of the removable lace bar 16 but not through the eyelets 12 of the underlying lateral lace bar 8. Once the removable lace bar has been correctly laced with the lacing member 14, the removable lace bar can then be adhered atop the lateral lace bar 8 via the cooperation of the hook-and-loop type fastening layers 18 and 20.

FIG. 3 illustrates the lacing configuration of the shoe of FIG. 1 in a conventional fastening mode. Lacing member 14 extends through the eyelets 12 of both removable lace bar 16 and lateral lace bar 8 such that these two lace bars function as a single lace bar, once they are secured together by the adjoining layers 18 and 20 of hook-and-loop material. It should be appreciated that the eyelets 12 on the removable lace bar 16 are aligned with the eyelets 12 on the lateral lace bar 8. Once the two lace bars are secured together, it is very difficult for a bystander to tell that the shoe is anything other than a conventional shoe having conventional lace bars. Thus, medial lace bar 10 and lateral lace bar 8 are secured via lacing member 14 which extends through the eyelets 12 on each.

FIG. 4 illustrates the top of a shoe utilizing a closure system according to the present invention configured in a quick-fastening mode. Lacing member 14 extends through eyelets 12 of removable lace bar 16, but not through eyelets of lateral lace bar 8 (hidden from view in FIG. 4). Lacing member 14 is laced alternately through an eyelet on medial lace bar 10 through an eyelet or removable lace bar 16 and then through another eyelet on medial lace bar 10.

The invention has been described with reference to the preferred embodiment. Obviously, modifications and alterations will occur to others upon reading and understanding of this specification. This specification is, therefore, intended to include all such modifications and alterations insofar as they come within the scope of the appended claims or equivalents thereof.

What is claimed is:

1. A footwear article comprising:

a shoe sole;

an upper that defines a space above the sole for receiving a wearer's foot;

a selectively configurable closure on the upper, including:

a) a first lace bar located on a first side of the upper and having a plurality of eyelets therein for receiving a lacing member, b) a second lace bar located on a second side of the upper and having a plurality of eyelets therein for selectively receiving a lacing member, c) a removable lace bar located on a second side of the upper and having a plurality of eyelets therein for receiving a lacing member, wherein the removable lace bar is shaped identical to the second lace bar and the first lace bar, d) means for removably fastening the removable lace bar to the second lace bar, and e) a lacing member extending at least through the eyelets of the first lace bar and the eyelets of the removable lace bar.

2. The footwear article according to claim 1, wherein the means for removably fastening comprises a hook-and-loop fastener.

3. The footwear article according to claim 1, wherein the removable lace bar is provided with the same number of eyelets as the second lace bar.

4. The footwear article according to claim 1, wherein the lacing member extends alternately through the eyelets of the removable lace bar and the eyelets of the first lace bar.

5. The footwear article according to claim 1, further comprising a tab extending from said removable lace bar for grasping by a person with limited dexterity.

6. A footwear article comprising:

a shoe sole;

an upper that defines a space above the sole for receiving a wearer's foot;

a selectively configurable closure on the upper, including:

a first stationary lace bar extending from the upper and having a plurality of eyelets therein for receiving a lacing member;

b) a second stationary lace bar extending from the upper and having a plurality of eyelets therein for receiving a lacing member;

c) a removable lace bar cooperatively associated with the first stationary lace bar and having a plurality of eyelets therein for receiving a lacing member;

d) fastener material disposed on the first stationary lace bar and the removable lace bar for selective fastening of the removable lace bar to the first stationary lace bar;

wherein the removable lace bar is shaped identical to the first and second stationary lace bars such that the closure is symmetrical when the removable lace bar is fastened to the first stationary lace bar.

7. The footwear article according to claim 6, further comprising a lacing member extending through one of the eyelets of the removable lace bar and through one of the eyelets of the second stationary lace bar.

8. The footwear article according to claim 6, wherein the eyelets of the removable lace bar are aligned with the eyelets of the first stationary lace bar and further comprising a lacing member extending alternately through one of the aligned eyelets of the removable lace bar and the first stationary lace bar and through one of the eyelets of the second stationary lace bar.

9. The footwear article according to claim 6, wherein the fastener material comprises a hook-and-loop type fastener material.

10. The footwear article according to claim 6, wherein the removable lace bar further comprises a protrusion having corners thereon for grasping by a person with limited dexterity.

11. The footwear article according to claim 6, further comprising a tab extending from the removable lace bar for grasping by a person with limited dexterity.

* * * * *